US009911393B2

(12) United States Patent
Wu

(10) Patent No.: US 9,911,393 B2
(45) Date of Patent: Mar. 6, 2018

(54) DEVICE AND METHOD FOR COMPENSATING VOLTAGE OF PRIMARY COLOR SUBPIXEL, AND DISPLAY DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventor: Hongjiang Wu, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 248 days.

(21) Appl. No.: 14/445,273

(22) Filed: Jul. 29, 2014

(65) Prior Publication Data

US 2015/0235616 A1 Aug. 20, 2015

(30) Foreign Application Priority Data

Feb. 19, 2014 (CN) ..... 2014 1 0056325

(51) Int. Cl.
*G09G 5/04* (2006.01)
*G09G 5/02* (2006.01)

(52) U.S. Cl.
CPC ..... *G09G 5/04* (2013.01); *G09G 5/02* (2013.01); *G09G 2310/027* (2013.01); (Continued)

(58) Field of Classification Search
CPC ..... G09G 2320/0242; G09G 5/02; G09G 5/04
See application file for complete search history.

(56) References Cited

U.S. PATENT DOCUMENTS 5,081,523 A * 1/1992 Frazier ..... H04N 9/73 348/178
2007/0091042 A1* 4/2007 Chung ..... G09G 3/3648 345/88

(Continued)

FOREIGN PATENT DOCUMENTS

CN 101465092 A 6/2009
CN 101944319 A 1/2011

(Continued)

OTHER PUBLICATIONS

First Office Action issued in Chinese application No. 201410056325.1 dated Jul. 23, 2015.

(Continued)

*Primary Examiner* — Michael Faragalla
*Assistant Examiner* — Chayce Bibbee
(74) *Attorney, Agent, or Firm* — Nath, Goldberg & Meyer; Joshua B. Goldberg

(57) ABSTRACT

The present invention provides a device and a method for compensating a voltage of a primary color subpixel, and a display device. The voltage compensation device includes: a grayscale determination module for determining whether a display grayscale value corresponding to a data voltage of the primary color subpixel is larger than a preset grayscale value; a first compensation module for performing voltage compensation on the primary color subpixel according to primary color mura information acquired in advance in a primary color test picture, when the display grayscale value is determined to be larger than the preset grayscale value; and a second compensation module for performing voltage compensation on the primary color subpixel according to gray mura information acquired in advance in a gray test picture, when the display grayscale value is determined to be equal to or smaller than the preset grayscale value.

16 Claims, 2 Drawing Sheets

(52) U.S. Cl.
CPC ..... *G09G 2320/0242* (2013.01); *G09G 2320/0666* (2013.01); *G09G 2320/0693* (2013.01); *G09G 2340/0457* (2013.01); *G09G 2360/147* (2013.01)

(56) References Cited

U.S. PATENT DOCUMENTS

| | | | | |
|---|---|---|---|---|
| 2009/0135211 | A1 | 5/2009 | Wang et al. | |
| 2010/0013751 | A1* | 1/2010 | Kerofsky ..... | G09G 3/006 345/89 |
| 2011/0234644 | A1* | 9/2011 | Park ..... | G09G 3/2003 345/690 |

FOREIGN PATENT DOCUMENTS

| | | | |
|---|---|---|---|
| CN | 102034407 | A | 4/2011 |
| CN | 103198801 | A | 7/2013 |
| CN | 103489405 | A | 1/2014 |
| JP | 2008250319 | A | 10/2008 |
| WO | 2013/008598 | A1 | 1/2013 |

OTHER PUBLICATIONS

Wu, Hong Jiang, et al, "Research and Improvement about Vertical Block Mura in TFT LCD Process", Chinese Journal of Liquid Crystals and Displays, vol. 22, No. 4, Aug. 2007, pp. 433-439, English Abstract Attached.

* cited by examiner

DEVICE AND METHOD FOR COMPENSATING VOLTAGE OF PRIMARY COLOR SUBPIXEL, AND DISPLAY DEVICE

FIELD OF THE INVENTION

The present invention relates to the field of display technology, and more particularly, to a device and a method for compensating a voltage of a primary color subpixel, and a display device.

BACKGROUND OF THE INVENTION

In a production procedure of a display device, generally, some abnormal subpixels are produced due to out-of-flatness of glass plate and problems occurred in fabricating process. Driven by a data voltage, an actual grayscale value represented by the abnormal subpixel is different from a display grayscale value corresponding to the data voltage, that is, there occurs a phenomenon that a picture displayed by the abnormal subpixel is brighter or darker than a picture displayed by the normal subpixel (the abnormal subpixel is unable to display preset brightness), so that a "moire" (mura) phenomenon occurs in the display picture of the display device, thereby degrading the display effect of the display device.

To solve the above problem, in addition to a source driver of the display device, a voltage compensation device may be generally added for performing the voltage compensation on the data voltage of the abnormal subpixels, so that the abnormal subpixel displays the preset brightness, and the mura in the display picture is eliminated.

In prior art, following steps are generally utilized to eliminate the mura in the display picture. Firstly, gray mura information in gray test picture is obtained and is stored in a storage module of a display module, and the gray mura information includes coordinate information and several voltage compensation tables. The coordinate information includes coordinates of all abnormal subpixels in the corresponding gray test picture, while each coordinate corresponds to one voltage compensation table, and each voltage compensation table includes a serial of data voltages and compensation voltages corresponding to the respective data voltages. Then, when the display device displays a picture, the voltage compensation device performs the voltage compensation on the abnormal subpixels in the display device according to the gray mura information stored in the storage module, so as to eliminate the mura in the display picture.

However, in an actual operation procedure, it is found that only general mura in the display picture can be eliminated by using the method in prior art, while a color mura generated when the display picture exhibits a specific color and brightness of region of the specific color is relatively high cannot be eliminated. For example, when the display picture exhibits a red color of high brightness, the red color mura in the display picture is conspicuous and can hardly be eliminated.

The reason why the color mura cannot be eliminated is that, when the voltage compensation is performed on the abnormal subpixels in the display device in prior art, it is only relied on the gray mura information acquired in the gray test picture. Since the color mura is not appeared in the gray test picture, voltage compensation information regarding the color mura is not included in the gray mura information, and thus the voltage compensation cannot be performed on the color mura generated in the display picture.

As can be seen from above, only the general mura in the display picture may be eliminated based on the voltage compensation method in prior art, while the color mura cannot be eliminated when the color mura is generated in the display picture, so that the display effect of the display device is degraded.

SUMMARY OF THE INVENTION

The present invention provides a device and a method for compensating a voltage of a primary color subpixel, and a display device, which can effectively eliminate the general mura and the color mura generated when the display device displays pictures, thereby improving the display effect of the display device.

In order to achieve the above object, the present invention provides a voltage compensation device for a primary color subpixel, including: a grayscale determination module for determining whether a display grayscale value corresponding to a data voltage of the primary color subpixel is larger than a preset grayscale value; a first compensation module for performing voltage compensation on the primary color subpixel according to primary color mura information acquired in advance in a primary color test picture, when the display grayscale value is determined to be larger than the preset grayscale value; and a second compensation module for performing voltage compensation on the primary color subpixel according to gray mura information acquired in advance in a gray test picture, when the display grayscale value is determined to be equal to or smaller than the preset grayscale value.

The primary color subpixel may comprise a red subpixel, a green subpixel or a blue subpixel; the primary color mura information may comprise red color mura information, green color mura information or blue color mura information.

The primary color test picture may include a plurality of the primary color subpixels; the red color mura information in the primary color test picture is acquired when the display grayscale value of the red subpixel is X1, the display grayscale value of the green subpixel is zero, and the display grayscale value of the blue subpixel is zero; the green color mura information in the primary color test picture is acquired when the display grayscale value of the red subpixel is zero, the display grayscale value of the green subpixel is X2, and the display grayscale value of the blue subpixel is zero; the blue color mura information in the primary color test picture is acquired when the display grayscale value of the red subpixel is zero, the display grayscale value of the green subpixel is zero, and the display grayscale value of the blue subpixel is X3; the gray mura information in the gray test picture is acquired when the display grayscale values of the red subpixel, the green subpixel and the blue subpixel are all X4; X1, X2, X3 and X4 are all integers and $0<X1\leq255$, $0<X2\leq255$, $0<X3\leq255$, $0\leq X4\leq255$.

For example, a value of X1 is 255, a value of X2 is 255, a value of X3 is 255, and a value of X4 is 63.

For example, when the primary color test picture is a red test picture, the display grayscale value of the red subpixel is 255, the display grayscale value of the green subpixel is 0, and the display grayscale value of the blue subpixel is 0.

The first compensation module may include: a first coordinate inquiry unit for inquiring whether coordinate information in the primary color mura information includes a coordinate of the primary color subpixel; a first voltage output unit for retrieving, when the coordinate information in the primary color mura information includes the coordinate of the primary color subpixel, a compensation voltage matched with the data voltage according to a voltage compensation table corresponding to the coordinate of the primary color subpixel in the primary color mura information, and outputting the compensation voltage; and a first voltage superimposition unit for superimposing the compensation voltage on the data voltage, so as to generate a driving voltage for driving the primary color subpixel.

The second compensation module may include: a second coordinate inquiry unit for inquiring whether coordinate information in the gray mura information includes a coordinate of the primary color subpixel; a second voltage output unit for retrieving, when the coordinate information in the gray mura information includes the coordinate of the primary color subpixel, a compensation voltage matched with the data voltage according to a voltage compensation table corresponding to the coordinate of the primary color subpixel in the gray mura information, and outputting the compensation voltage; and a second voltage superimposition unit for superimposing the compensation voltage on the data voltage, so as to generate a driving voltage for driving the primary color subpixel.

The voltage compensation device for the primary color subpixel may further include: a storage module for storing the primary color mura information and the gray mura information; and a source driver for supplying the data voltage to a pixel electrode of the primary color subpixel.

The display grayscale value is an ideal value of the grayscale corresponding to the primary color subpixel when the data voltage is applied to the pixel electrode of the primary color subpixel.

In order to achieve the above object, the present invention provides a display device, including the voltage compensation device for the primary color subpixel described above.

In order to achieve the above object, the present invention provides a method for compensating a voltage of a primary color subpixel, including steps of: determining whether a display grayscale value corresponding to a data voltage of the primary color subpixel is larger than a preset grayscale value; performing voltage compensation on the primary color subpixel according to primary color mura information acquired in advance in a primary color test picture, when the display grayscale value is determined to be larger than the preset grayscale value; and performing voltage compensation on the primary color subpixel according to gray mura information acquired in advance in a gray test picture, when the display grayscale value is determined to be equal to or smaller than the preset grayscale value.

In the method, the primary color subpixel may comprise a red subpixel, a green subpixel or a blue subpixel.

In the method, the step of performing the voltage compensation on the primary color subpixel according to the primary color mura information acquired in advance in the primary color test picture includes: inquiring whether coordinate information in the primary color mura information includes a coordinate of the primary color subpixel; when the coordinate information in the primary color mura information includes the coordinate of the primary color subpixel, retrieving a compensation voltage matched with the data voltage according to a voltage compensation table corresponding to the coordinate of the primary color subpixel in the primary color mura information, and outputting the compensation voltage; and superimposing the compensation voltage on the data voltage, so as to generate a driving voltage for driving the primary color subpixel.

In the method, the step of performing the voltage compensation on the primary color subpixel according to the gray mura information acquired in advance in the gray test picture includes: inquiring whether coordinate information in the gray mura information includes a coordinate of the primary color subpixel; when the coordinate information in the gray mura information includes the coordinate of the primary color subpixel, retrieving a compensation voltage matched with the data voltage according to a voltage compensation table corresponding to the coordinate of the primary color subpixel in the gray mura information, and outputting the compensation voltage; and superimposing the compensation voltage on the data voltage, so as to generate a driving voltage for driving the primary color subpixel.

In the embodiments of the present invention, the voltage compensation is performed on the primary color subpixel by determining whether the display grayscale value corresponding to the data voltage of the primary color subpixel is larger than the preset grayscale value and selecting the primary color mura information or the gray mura information based on the determination result, and thus the general mura and the color mura in the display picture may be effectively eliminated, thereby improving the display effect of the display device.

DESCRIPTION OF THE PREFERRED EMBODIMENT

Hereinafter, for the person skilled in the art to better understand the technical solution of the present invention, a device and a method for compensating a voltage of primary color subpixel, and a display device will be described in detail with reference to the accompanying drawings and the exemplary embodiments.

First Embodiment

Figure 1:
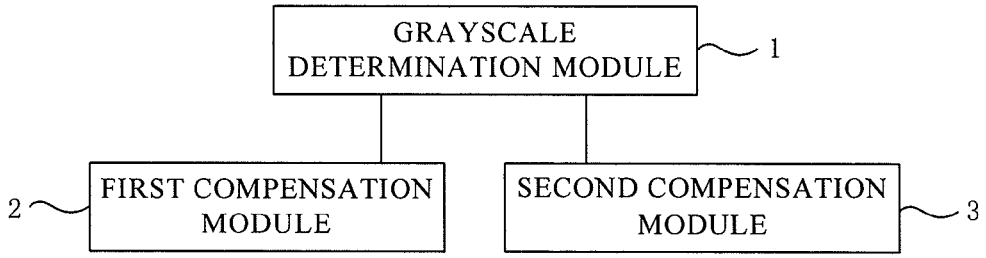
FIG. 1 is a structure diagram of a voltage compensation device for primary color subpixel according to a first embodiment of the present invention.
Figure 2:
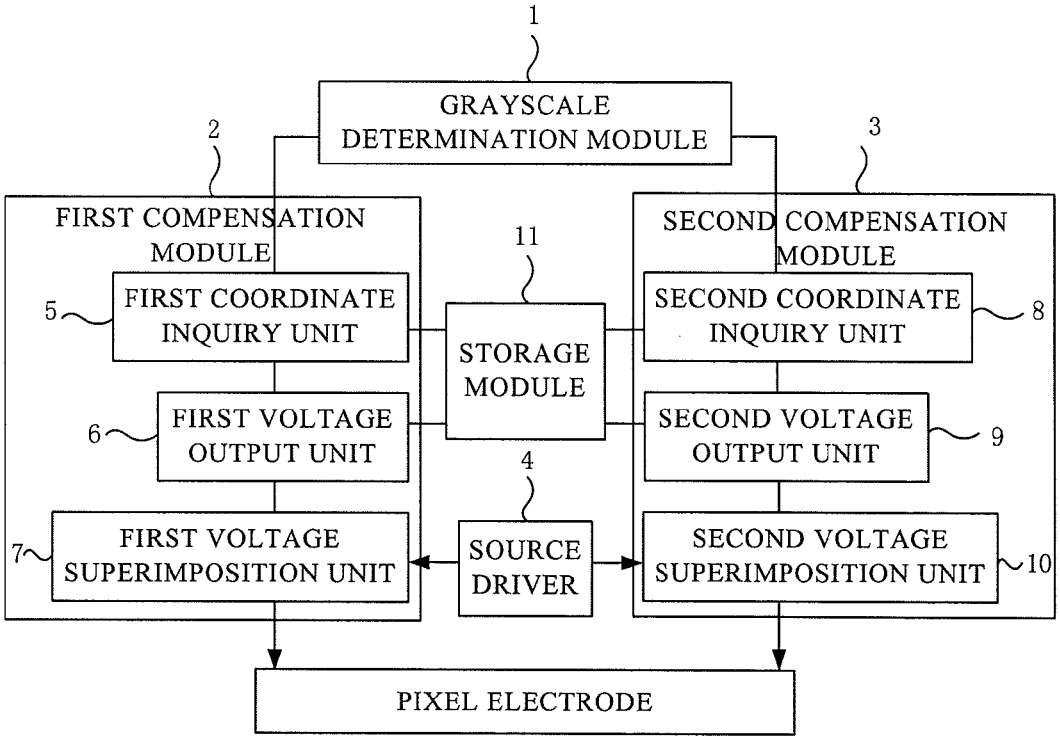
FIG. 2 is a diagram illustrating that the voltage compensation device of the primary color subpixel in FIG. 1 performs the voltage compensation.

FIG. 1 is a structure diagram of a voltage compensation device for primary color subpixel according to a first embodiment of the present invention, FIG. 2 is a diagram illustrating that the voltage compensation device of primary color subpixel in FIG. 1 performs the voltage compensation. As shown in FIG. 1 and FIG. 2, the voltage compensation device includes a grayscale determination module 1, a first compensation module 2 and a second compensation module 3. The grayscale determination module 1 determines whether a display grayscale value corresponding to a data voltage of a primary color subpixel is larger than a preset grayscale value. The first compensation module 2 performs voltage compensation on the primary color subpixel according to primary color mura information acquired in advance in primary color test picture, in a case where the display grayscale value is determined to be larger than the preset grayscale value. The second compensation module 3 performs voltage compensation on the primary color subpixel according to gray mura information acquired in advance in gray test picture, in a case where the display grayscale value is determined to be equal to or smaller than the preset grayscale value.

It should be noted that, the data voltage in the present invention is an original voltage applied to a pixel electrode of the primary color subpixel, and the data voltage may be provided by a source driver 4 in the display device. The display grayscale value (an integer value between 0 and 255, comprising 0 and 255) is an ideal value of the grayscale corresponding to the primary color subpixel when the data voltage is applied to the pixel electrode, the larger the display grayscale value is, the brighter the light emitted from the corresponding primary color subpixel becomes. When picture display is performed, there exists a one to one correspondence between the data voltage and the display grayscale value.

In addition, in the technical solution of the present invention, when the primary color mura information in the primary color test picture is acquired in advance, the primary color mura in the primary color test picture may be captured. Therefore, the primary color mura in the display picture may be compensated based on the corresponding primary color mura information.

In the embodiment of the present invention, when the display picture exhibits high brightness (corresponding primary color subpixels are of high grayscale displaying), the general mura in the display picture is not conspicuous, while the color mura is conspicuous, and thus the voltage compensation may be performed on the primary color subpixel by using the corresponding primary color mura information; whereas, when the display picture exhibits low brightness (corresponding primary color subpixels are of low grayscale displaying), the general mura in the display picture is conspicuous, while the color mura is not conspicuous, and thus the voltage compensation may be performed on the primary color subpixel by using the gray mura information.

Further, in order to make determination as to whether the primary color subpixel is of the high grayscale displaying or of the low grayscale displaying, there is provided a preset grayscale value in the technical solution of the present invention. When the display grayscale value corresponding to the primary color subpixel is larger than the preset grayscale value, the primary color subpixel is determined to be of the high grayscale displaying; whereas, when the display grayscale value corresponding to the primary color subpixel is equal to or smaller than the preset grayscale value, the primary color subpixel is determined to be of the low grayscale displaying. In the embodiment, the preset grayscale value may be 127, and the preset grayscale value may be adjustable according to the actual situation.

The primary color subpixel may include a red subpixel, a green subpixel or a blue subpixel, and the corresponding primary color mura information may include red color mura information, green color mura information or blue color mura information. Specifically, when the primary color subpixel is the red subpixel, the corresponding primary color test picture is a red test picture, the corresponding primary color mura information is the red color mura information, and the corresponding primary color mura is a red color mura; when the primary color subpixel is the green subpixel, the corresponding primary color test picture is a green test picture, the corresponding primary color mura information is the green color mura information, and the corresponding primary color mura is a green color mura; and when the primary color subpixel is the blue subpixel, the corresponding primary color test picture is a blue test picture, the corresponding primary color mura information is the blue color mura information, and the corresponding primary color mura is a blue color mura. The primary color subpixel in the embodiment may also comprise other color, and description thereof may be omitted herein.

The voltage compensation device may further include a storage module 11 for storing the primary color mura information and the gray mura information.

A procedure of acquiring the red color mura information in the red test picture will be described in detail below, the procedure includes following step A through step D.

In step A, the display device is adjusted to the red test picture, and grayscale information of the red test picture is acquired by a mura scanner. The grayscale information includes coordinate information and corresponding grayscale value (value between 0 and 100%) of each red subpixel in the display device.

In step B, a normal region and a mura region in the red test picture are determined according to the grayscale information. The red subpixel in the normal region is the normal subpixel, the red subpixel in the mura region is the abnormal subpixel, and the coordinate information in the red color mura information consists of the coordinates of all abnormal subpixels.

It should be noted that, a plurality of primary color subpixels are included in the display device, and the picture display is performed by coordination of all primary color subpixels. When the display grayscale value of the red subpixel is X1, the display grayscale value of the green subpixel is 0, and the display grayscale value of the blue subpixel is 0, the display device displays the red test picture, X1 is an integer and $0<X1\leq 255$. When X1 is 255, the red test picture exhibits the largest brightness, the red color mura is in a state of most conspicuous, and the coordinate information of the abnormal subpixels acquired in the red test picture at this time is the most complete.

In step C, a voltage compensation table is generated for each abnormal subpixel. The voltage compensation table includes a serial of data voltages and compensation voltages corresponding to the respective data voltages. Each data voltage corresponds to a unique compensation voltage, and the compensation voltage may be a positive or a negative voltage.

Figure 3:
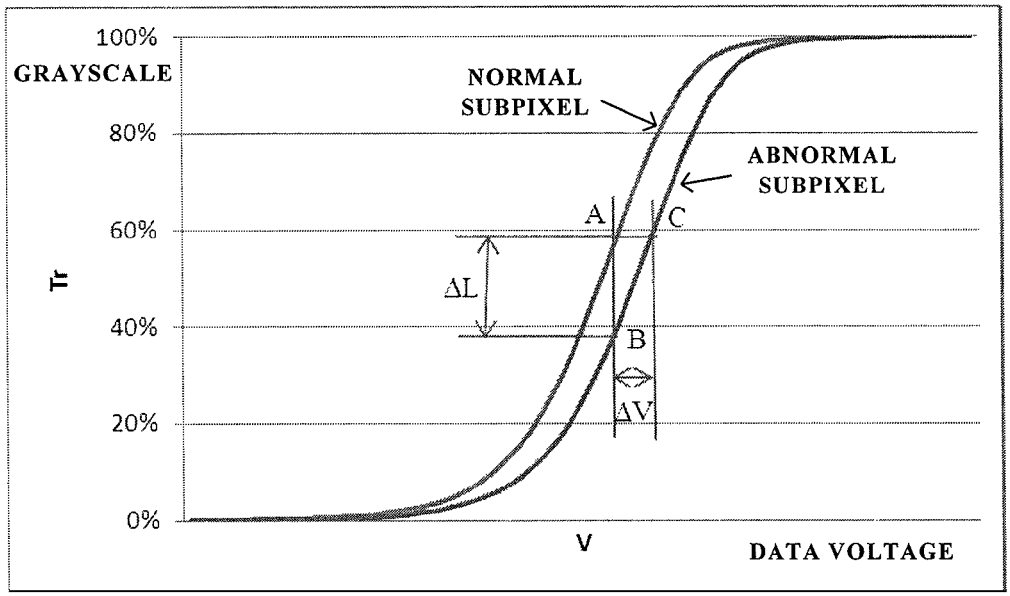
FIG. 3 is a graph illustrating that a compensation voltage is calculated according to a data voltage.

A procedure of generating the voltage compensation table will be described in detail below with reference to drawings. FIG. 3 is a graph illustrating that the compensation voltage is calculated according to the data voltage. As shown in FIG. 3, when the data voltage is V1, the grayscale value of corresponding normal subpixel is L1 (i.e., point A), and the grayscale value of corresponding abnormal subpixel is L2 (i.e., point B), a difference therebetween is ΔL. In order to make the grayscale value of the abnormal subpixel to be L1, the data voltage V1 is required to be compensated. When the voltage on the pixel electrode corresponding to the abnormal subpixel is V2 (i.e., point C), the value of grayscale displayed by the abnormal subpixel is L1. Therefore, the compensation voltage corresponding to the data voltage V1 is: $\Delta V=V2-V1$. Then, the voltage compensation table of the abnormal subpixels may be obtained by inputting a plurality of data voltages V1s and calculating the corresponding ΔVs.

In step D, the mura information in the red test picture is generated according to the coordinate information and the voltage compensation table corresponding to each coordinate, and the mura information is stored in the storage module.

It should be noted that, regarding to the mura information in the red test picture, there is one to one correspondence between the coordinate in the coordinate information and the voltage compensation table.

Procedure of acquiring the mura information in the green test picture, the blue test picture or the gray test picture is similar to that of acquiring the mura information in the red test picture, except that the display device is required to be adjusted to the test picture of corresponding color (green, blue or gray).

Specifically, when the display grayscale value of the red subpixel is 0, the display grayscale value of the green subpixel is X2, and the display grayscale value of the blue subpixel is 0, the display device displays the green test picture, X2 is an integer and $0<X2\leq255$; the green color mura information may be acquired based on the green test picture at this time, and the coordinate information of the abnormal subpixels acquired in the green test picture is the most complete when X2 is 255. When the display grayscale value of the red subpixel is 0, the display grayscale value of the green subpixel is 0, and the display grayscale value of the blue subpixel is X3, the display device displays the blue test picture, X3 is an integer and $0<X3\leq255$; the blue color mura information may be acquired based on the blue test picture at this time, and the coordinate information of the abnormal subpixels acquired in the blue test picture is the most complete when X3 is 255. When the display grayscale values of the red subpixel, the green subpixel and the blue subpixel are all X4, the display device displays the gray test picture, X4 is an integer and $0\leq X4\leq255$; optionally, when X4 is 63, the general mura in the gray test picture is relatively conspicuous, in this case, the coordinate information of the abnormal subpixels acquired in the gray test picture is the most complete.

The technical solution of the present invention will be described in detail by taking the red subpixels as an example for performing the voltage compensation.

Firstly, the grayscale determination module 1 determines whether the display grayscale value of the red subpixel is larger than the preset grayscale value. Then, when the grayscale determination module 1 determines that the display grayscale value of the red subpixel is larger than the preset grayscale value, the first compensation module 2 performs voltage compensation on the red subpixel according to the red color mura information acquired in advance. When the display grayscale value of the red subpixel is equal to or smaller than the preset grayscale value, the second compensation module 3 performs voltage compensation on the red subpixel according to the gray mura information acquired in advance.

Specifically, the first compensation module 2 includes a first coordinate inquiry unit 5, a first voltage output unit 6 and a first voltage superimposition unit 7. The first coordinate inquiry unit 5 inquiries whether the coordinate information in the primary color mura information includes the coordinate of the primary color subpixel. The first voltage output unit 6 retrieves, when the coordinate information in the primary color mura information includes the coordinate of the primary color subpixel, the compensation voltage matched with the data voltage according to the voltage compensation table corresponding to the coordinate of the primary color subpixel in the primary color mura information, and outputs the compensation voltage. The first voltage superimposition unit 7 superimposes the compensation voltage on the data voltage, so as to generate a driving voltage for driving the primary color subpixel.

When the grayscale determination module 1 determines that the display grayscale value of the red subpixel is larger than the preset grayscale, the first coordinate inquiry unit 5 inquiries the coordinate information in the red color mura information. If the coordinate of the red subpixel is not found in the coordinate information in the red color mura information, it means that the red subpixel is the normal subpixel in the red test picture, and thus the voltage compensation is not required to be performed. In this case, the voltage applied to the pixel electrode is the data voltage. If the coordinate of the red subpixel is found in the coordinate information in the red color mura information, it means that the red subpixel is the abnormal subpixel in the red test picture, and thus the voltage compensation is required to be performed. In this case, the first voltage output unit 6 is activated. The first voltage output unit 6 selects the voltage compensation table corresponding to the coordinate of the red subpixel according to the coordinate, retrieves the compensation voltage matched with the data voltage in the voltage compensation table, and outputs the compensation voltage to the first voltage superimposition unit 7. The first voltage superimposition unit 7 superimposes the compensation voltage on the data voltage, so as to generate the driving voltage for driving the red subpixel, and the voltage compensation procedure for the red subpixel is finished. In this case, the voltage applied to the pixel electrode is sum of the data voltage and the compensation voltage. It should be noted that, the coordinate of the red subpixel may be provided by a timing controller.

The second compensation module 3 includes a second coordinate inquiry unit 8, a second voltage output unit 9 and a second voltage superimposition unit 10. The second coordinate inquiry unit 8 inquiries whether the coordinate information in the gray mura information includes the coordinate of the primary color subpixel. The second voltage output unit 9 retrieves, when the coordinate information in the gray mura information includes the coordinate of the primary color subpixel, the compensation voltage matched with the data voltage according to the voltage compensation table corresponding to the coordinate of the primary color subpixel in the gray mura information, and outputs the compensation voltage. The second voltage superimposition unit 10 superimposes the compensation voltage on the data voltage, so as to generate a driving voltage for driving the primary color subpixel.

It should be noted that, the structure and the compensation procedure of the second compensation module 3 are similar to that of the first compensation module 2, except that the compensation procedure of the first compensation module 2 is based on the primary color mura information, and the compensation procedure of the second compensation module 3 is based on the gray mura information.

It should be noted that, when the primary color subpixel is the green subpixel, the compensation is performed on the green subpixel according to the green color mura information or the gray mura information; when the primary color subpixel is the blue subpixel, the compensation is performed on the bule subpixel according to the bule color mura information or the gray mura information. The detailed voltage compensation procedure for green or blue subpixel is similar to the procedure of performing the voltage compensation on the red subpixel, and will be omitted herein.

The technical solution in the present invention differs from the prior art in that, two kinds of mura information is provided for each primary color subpixel, when the primary color subpixel is of high grayscale displaying, the voltage compensation is performed on the primary color subpixel by using corresponding primary color mura information, thereby eliminating the color mura that is conspicuous when the display picture exhibits high brightness; when the primary color subpixel is of low grayscale displaying, the voltage compensation is performed on the primary color subpixel by using the gray mura information, thereby eliminating the general mura that is conspicuous when the display picture exhibits low brightness.

In the voltage compensation device for primary color subpixel according to the first embodiment of the present invention, it is determined whether the display grayscale value corresponding to the data voltage of the primary color subpixel is larger than the preset grayscale value and the corresponding compensation module is selected based on the determination result, so that the general mura and the color mura in the display picture can be effectively eliminated by performing the voltage compensation on the primary color subpixel, thereby improving the display effect of the display device.

Second Embodiment

The second embodiment of the present invention provides a display device, including a voltage compensation device for primary color subpixel. The voltage compensation device utilizes the configuration of the voltage compensation device for primary color subpixel in the first embodiment described above, and details thereof are described in the first embodiment and will be omitted herein.

In the display device according to the second embodiment of the present invention, with the determination as to whether the display grayscale value of the primary color subpixel is of high grayscale displaying or low grayscale displaying and the selection of the corresponding compensation module based on the determination result, the general mura and the color mura in the display picture may be effectively eliminated by performing the voltage compensation on the primary color subpixel, thereby improving the display effect of the display device.

Third Embodiment

Figure 4:
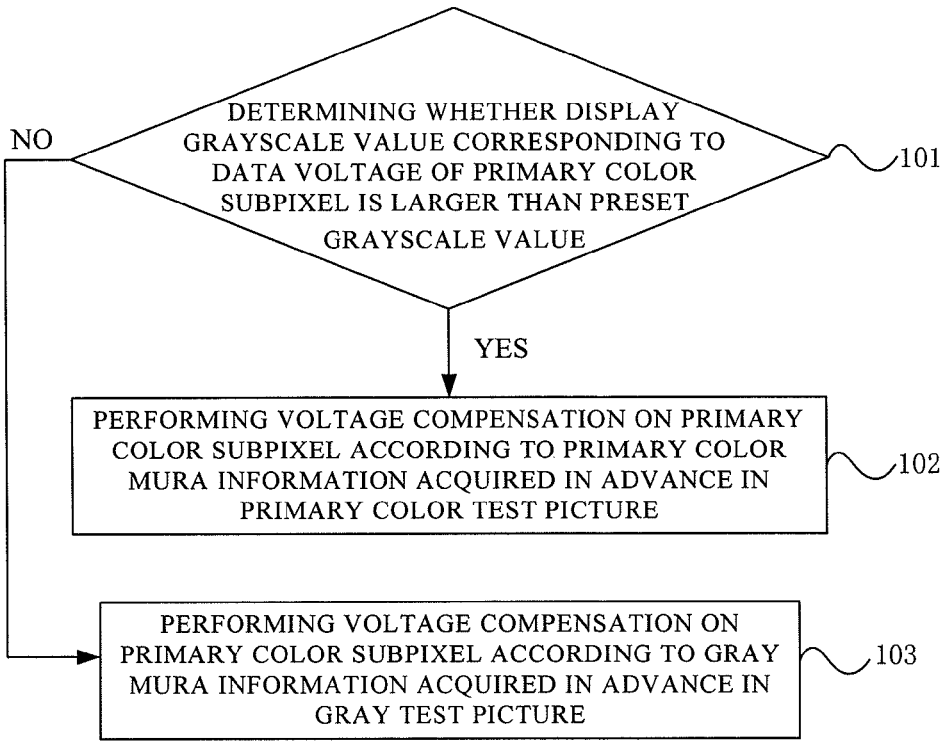
FIG. 4 is a flowchart of a method for compensating a voltage of the primary color subpixel according to a third embodiment of the present invention.

FIG. 4 is a flowchart of a method for compensating a voltage of primary color subpixel according to the third embodiment. As shown in FIG. 4, the voltage compensation method includes following steps 101, 102 and 103.

Step 101: determining whether a display grayscale value corresponding to a data voltage of primary color subpixel is larger than a preset grayscale value.

The step 101 may be performed by the grayscale determination module in the first embodiment described above. The data voltage in this embodiment is an original voltage applied to a pixel electrode of the primary color subpixel, and the data voltage may be provided by a source driver in a display device. The display grayscale value is a value of display grayscale corresponding to the primary color subpixel when the data voltage is applied to the pixel electrode. In addition, in order to make a definitive determination as to whether the primary color subpixel is of high grayscale displaying or low grayscale displaying, a preset grayscale value is provided in the technical solution of the present invention. When the display grayscale value corresponding to the primary color subpixel is larger than the preset grayscale value, the primary color subpixel is determined to be of high grayscale displaying. When the display grayscale value corresponding to the primary color subpixel is equal to or smaller than the preset grayscale value, the primary color subpixel is determined to be of low grayscale displaying. In the embodiment, the preset grayscale value may be 127, and proper adjustment may be made to the preset grayscale value according to actual situation.

The primary color subpixel may include a red subpixel, a green subpixel or a blue subpixel. When the primary color subpixel is the red subpixel, the corresponding primary color test picture is a red test picture, and the corresponding primary color mura information is red color mura information; when the primary color subpixel is the green subpixel, the corresponding primary color test picture is a green test picture, and the corresponding primary color mura information is green color mura information; and when the primary color subpixel is the blue subpixel, the corresponding primary color test picture is a blue test picture, and the corresponding primary color mura information is blue color mura information. The primary color subpixel in the embodiment may also comprise other color, and description thereof may be omitted herein.

When the display grayscale value corresponding to the data voltage of the primary color subpixel is determined to be larger than the preset grayscale value in the step 101 ("YES" in the step 101 in FIG. 4), a step 102 is performed.

Step 102: performing voltage compensation on the primary color subpixel according to the primary color mura information acquired in advance in the primary color test picture.

The step 102 may be performed by the first compensation module in the first embodiment described above, and the step 102 may include following steps 1021, 1022 and 1023.

Step 1021: inquiring whether coordination information in the primary color mura information includes a coordinate of the primary color subpixel.

The step 1021 may be performed by the first coordinate inquiry unit in the first embodiment described above.

When the display grayscale value is determined to be larger than the preset grayscale value, it means that the primary color subpixel is of high grayscale displaying. In this case, the general mura in the display picture is not conspicuous, while the color mura is conspicuous, and thus the voltage compensation is required to be performed on the primary color subpixel according to the primary color mura information. A determination as to whether the primary color subpixel is the abnormal subpixel in the corresponding primary color test picture is required to be made before the voltage compensation is performed, and thus, the determination may be made by inquiring whether the coordination information in the primary color mura information includes the coordinate of the primary color subpixel.

Taking a case where the primary color subpixel is the red subpixel as an example, in this case, the corresponding primary color test picture is the red test picture, and the corresponding primary color mura information is the red color mura information.

In the step 1021, if the coordinate of the red subpixel is not found in the coordinate information in the red color mura information, it means that the red subpixel is the normal subpixel in the red test picture, and thus the voltage compensation is not required to be performed, and the procedure is finished. In this case, the voltage input to the pixel electrode of the red subpixel is the data voltage.

If the coordinate of the red subpixel is found in the coordinate information in the red color mura information, it means that the red subpixel is the abnormal subpixel in the red test picture, and thus the voltage compensation is required to be performed, and the procedure proceeds to following step 1022. It should be noted that, the coordinate of the red subpixel may be provided by a timing controller.

Step 1022: when it is determined that the coordinate information in the primary color mura information includes the coordinate of the primary color subpixel, retrieving a compensation voltage matched with the data voltage according to a voltage compensation table corresponding to the coordinate of the primary color subpixel in the primary color mura information, and outputting the compensation voltage.

The step 1022 may be performed by the first voltage output unit in the first embodiment described above.

In the step 1022, the voltage compensation table corresponding to the coordinate of the red subpixel is selected according to the coordinate, the compensation voltage matched with the data voltage is retrieved in the voltage compensation table, and the compensation voltage is output.

Step 1023: superimposing the compensation voltage on the data voltage, so as to generate a driving voltage for driving the primary color subpixel.

The step 1023 may be performed by the first voltage superimposition unit in the first embodiment described above.

In the step 1023, the compensation voltage is superimposed on the data voltage, so as to generate the driving voltage for driving the red subpixel, and the voltage compensation procedure for the red subpixel is finished.

When the display grayscale value corresponding to the data voltage of the primary color subpixel is determined to be equal to or smaller than the preset grayscale value ("NO" in the step 101 in FIG. 4), it proceeds to following step 103.

Step 103: performing voltage compensation on the primary color subpixel according to the gray mura information acquired in advance in the gray test picture.

The step 103 may be performed by the second compensation module in the first embodiment described above, and the step 103 may include following steps 1031, 1032 and 1033.

Step 1031: inquiring whether coordination information in the gray mura information includes a coordinate of the primary color subpixel.

Step 1032: when it is determined that the coordinate information in the gray mura information includes the coordinate of the primary color subpixel, retrieving a compensation voltage matched with the data voltage according to a voltage compensation table corresponding to the coordinate of the primary color subpixel in the gray mura information, and outputting the compensation voltage.

Step 1033: superimposing the compensation voltage on the data voltage, so as to generate a driving voltage for driving the primary color subpixel.

It should be noted that, the procedure of the step 103 is similar to that of the step 102, except that the mura information selected when performing the voltage compensation in the step 103 is the gray mura information. The step 1031 may be performed by the second coordinate inquiry unit in the first embodiment described above. The step 1032 may be performed by the second voltage output unit in the first embodiment described above. The step 1033 may be performed by the second voltage superimposition unit in the first embodiment described above.

In the voltage compensation method of primary color subpixel according to the third embodiment of the present invention, it is determined whether the display grayscale value of the primary color subpixel is of high grayscale displaying or low grayscale displaying and the corresponding compensation module is selected based on the determination result, so that the general mura and the color mura in the display picture can be effectively eliminated by performing the voltage compensation on the primary color subpixel, thereby improving the display effect of the display device.

It should be appreciated that the above embodiments are only the exemplary embodiments employed for illustrating the principle of the present invention, but the present invention is not limited thereto. It will be apparent to those skilled in the art that modifications and variations can be made without departing from the spirit and scope of the present invention, and these modifications and variations are also considered to fall within the scope of protection of the present invention.

The invention claimed is:

1. A voltage compensation device for a primary color subpixel, including:

a grayscale determinator for determining whether a display grayscale value corresponding to a data voltage of the primary color subpixel is larger than a preset grayscale value, and for determining, based on a result of determining whether display grayscale value corresponding to the data voltage of the primary color subpixel is larger than the preset grayscale value, whether to select primary color mura information acquired in advance in a primary color test picture or gray mura information acquired in advance in a gray test picture to perform voltage compensation;

a first compensator for performing the voltage compensation on the primary color subpixel according to the primary color mura information acquired in primary color test pictures of different colors when the display grayscale value is determined to be larger than the preset grayscale value; and a second compensator for performing the voltage compensation on the primary color subpixel according to the gray mura information acquired in the gray test picture, in which the display grayscale values of respective colors are equal to each other, when the display grayscale value is determined to be equal to or smaller than the preset grayscale value;

wherein with respect to the primary color subpixel displaying a specific primary color, the primary color mura information for the specific primary color is obtained under the primary color test picture having the specific primary color, and the first compensator performs the voltage compensation on the primary color subpixel displaying the specific primary color according to the primary color mura information for the specific primary color.

2. The voltage compensation device of claim 1, wherein the primary color subpixel comprises a red subpixel, a green subpixel or a blue subpixel; and the primary color mura information comprises red color mura information, green color mura information or blue color mura information.

3. The voltage compensation device of claim 2, wherein the primary color test picture includes a plurality of the primary color subpixels;

the red color mura information in the primary color test picture is acquired when the display grayscale value of the red subpixel is X1, the display grayscale value of the green subpixel is zero, and the display grayscale value of the blue subpixel is zero;

the green color mura information in the primary color test picture is acquired when the display grayscale value of the red subpixel is zero, the display grayscale value of the green subpixel is X2, and the display grayscale value of the blue subpixel is zero;

the blue color mura information in the primary color test picture is acquired when the display grayscale value of the red subpixel is zero, the display grayscale value of the green subpixel is zero, and the display grayscale value of the blue subpixel is X3; and the gray mura information in the gray test picture is acquired when the display grayscale values of the red subpixel, the green subpixel and the blue subpixel are all X4, wherein $0<X1\leq255$, $0<X2\leq255$, $0<X3\leq255$, $0\leq X4\leq255$, and X1, X2, X3 and X4 are all integers.

4. The voltage compensation device of claim 3, wherein a value of X1 is 255, a value of X2 is 255, a value of X3 is 255, and a value of X4 is 63.

5. The voltage compensation device of claim 1, wherein the first compensator includes:

a first coordinate inquirer for inquiring whether coordinate information in the primary color mura information includes a coordinate of the primary color subpixel;

a first voltage outputter for retrieving, when the coordinate information in the primary color mura information includes the coordinate of the primary color subpixel, a compensation voltage matched with the data voltage according to a voltage compensation table corresponding to the coordinate of the primary color subpixel in the primary color mura information, and outputting the compensation voltage; and a first voltage superimposer for superimposing the compensation voltage on the data voltage, so as to generate a driving voltage for driving the primary color subpixel.

6. The voltage compensation device of claim 1, wherein the second compensator includes:

a second coordinate inquirer for inquiring whether coordinate information in the gray mura information includes a coordinate of the primary color subpixel;

a second voltage outputter for retrieving, when the coordinate information in the gray mura information includes the coordinate of the primary color subpixel, a compensation voltage matched with the data voltage according to a voltage compensation table corresponding to the coordinate of the primary color subpixel in the gray mura information, and outputting the compensation voltage; and a second voltage superimposer for superimposing the compensation voltage on the data voltage, so as to generate a driving voltage for driving the primary color subpixel.

7. The voltage compensation device of claim 1, further including:

a storage for storing the primary color mura information and the gray mura information.

8. The voltage compensation device of claim 1, further including:

a source driver for supplying the data voltage to a pixel electrode of the primary color subpixel.

9. The voltage compensation device of claim 1, wherein the display grayscale value is an ideal value of the grayscale corresponding to the primary color subpixel when the data voltage is applied to a pixel electrode of the primary color subpixel.

10. A display device, including a voltage compensation device for a primary color subpixel, wherein the voltage compensation device for the primary color subpixel includes:

a grayscale determinator for determining whether a display grayscale value corresponding to a data voltage of the primary color subpixel is larger than a preset grayscale value, and for determining, based on a result of determining whether the display grayscale value corresponding to the data voltage of the primary color subpixel is larger than the preset grayscale value, whether to select primary color mura information acquired in advance in a primary color test picture or gray mura information acquired in advance in a gray test picture to perform voltage compensation;

a first compensator for performing the voltage compensation on the primary color subpixel according to the primary color mura information acquired in primary color test pictures of different colors when the display grayscale value is determined to be larger than the preset grayscale value; and a second compensator for performing the voltage compensation on the primary color subpixel according to the gray mura information acquired in the gray test picture, in which the display grayscale values of respective colors are equal to each other, when the display grayscale value is determined to be equal to or smaller than the preset grayscale value;

wherein with respect to the primary color subpixel displaying a specific primary color, the primary color mura information for the specific primary color is obtained under the primary color test picture having the specific primary color, and the first compensator performs the voltage compensation on the primary color subpixel displaying the specific primary color according to the primary color mura information for the specific primary color.

11. The display device of claim 10, wherein the first compensator includes:

a first coordinate inquirer for inquiring whether coordinate information in the primary color mura information includes a coordinate of the primary color subpixel;

a first voltage outputter for retrieving, when the coordinate information in the primary color mura information includes the coordinate of the primary color subpixel, a compensation voltage matched with the data voltage according to a voltage compensation table corresponding to the coordinate of the primary color subpixel in the primary color mura information, and outputting the compensation voltage; and a first voltage superimposer for superimposing the compensation voltage on the data voltage, so as to generate a driving voltage for driving the primary color subpixel.

12. The display device of claim 10, wherein the second compensator includes:

a second coordinate inquirer for inquiring whether coordinate information in the gray mura information includes a coordinate of the primary color subpixel;

a second voltage outputter for retrieving, when the coordinate information in the gray mura information includes the coordinate of the primary color subpixel, a compensation voltage matched with the data voltage according to a voltage compensation table corresponding to the coordinate of the primary color subpixel in the gray mura information, and outputting the compensation voltage; and a second voltage superimposer for superimposing the compensation voltage on the data voltage, so as to generate a driving voltage for driving the primary color subpixel.

13. A method for compensating a voltage of a primary color subpixel, including steps of:

determining whether a display grayscale value corresponding to a data voltage of the primary color subpixel is larger than a preset grayscale value, and determining, based on a result of determining whether the display grayscale value corresponding to the data voltage of the primary color subpixel is larger than the preset grayscale value, whether to select primary color mura information acquired in advance in a primary color test picture or gray mura information acquired in advance in a gray test picture to perform voltage compensation;

performing the voltage compensation on the primary color subpixel according to the primary color mura information acquired in primary color test pictures of different colors when the display grayscale value is determined to be larger than the preset grayscale value; and performing the voltage compensation on the primary color subpixel according to the gray mura information acquired in the gray test picture, in which the display grayscale values of respective colors are equal to each other, when the display grayscale value is determined to be equal to or smaller than the preset grayscale value, wherein with respect to the primary color subpixel displaying a specific primary color, the primary color mura information for the specific primary color is obtained under the primary color test picture having the specific primary color, and the first compensator performs the voltage compensation on the primary color subpixel displaying the specific primary color according to the primary color mura information for the specific primary color.

14. The method of claim 13, wherein the primary color subpixel comprises a red subpixel, a green subpixel or a blue subpixel.

15. The method of claim 13, wherein the step of performing the voltage compensation on the primary color subpixel according to the primary color mura information acquired in advance in the primary color test picture includes:

inquiring whether coordinate information in the primary color mura information includes a coordinate of the primary color subpixel;

retrieving, when the coordinate information in the primary color mura information includes the coordinate of the primary color subpixel, a compensation voltage matched with the data voltage according to a voltage compensation table corresponding to the coordinate of the primary color subpixel in the primary color mura information, and outputting the compensation voltage; and superimposing the compensation voltage on the data voltage, so as to generate a driving voltage for driving the primary color subpixel.

16. The method of claim 13, wherein the step of performing the voltage compensation on the primary color subpixel according to the gray mura information acquired in advance in the gray test picture includes:

inquiring whether coordinate information in the gray mura information includes a coordinate of the primary color subpixel;

retrieving, when the coordinate information in the gray mura information includes the coordinate of the primary color subpixel, a compensation voltage matched with the data voltage according to a voltage compensation table corresponding to the coordinate of the primary color subpixel in the gray mura information, and outputting the compensation voltage; and superimposing the compensation voltage on the data voltage, so as to generate a driving voltage for driving the primary color subpixel.

* * * * *